US011492723B2

(12) United States Patent
Ou

(10) Patent No.: US 11,492,723 B2
(45) Date of Patent: Nov. 8, 2022

(54) ELECTROLYTE SOLUTIONS FOR ELECTROPOLISHING OF NITINOL NEEDLES

(71) Applicant: Ethicon LLC, Guaynabo, PR (US)

(72) Inventor: Duan Li Ou, Warren, NJ (US)

(73) Assignee: CILAG GmbH International, Zug (CH)

( * ) Notice: Subject to any disclaimer, the term of this patent is extended or adjusted under 35 U.S.C. 154(b) by 169 days.

(21) Appl. No.: 16/674,168

(22) Filed: Nov. 5, 2019

(65) Prior Publication Data

US 2021/0130978 A1 May 6, 2021

(51) Int. Cl.

| | |
|---|---|
| ***C25F 3/22*** | (2006.01) |
| ***C25F 3/18*** | (2006.01) |
| *C25F 3/26* | (2006.01) |

(52) U.S. Cl.

CPC ..... *C25F 3/22* (2013.01); *C25F 3/18* (2013.01); *C25F 3/26* (2013.01)

(58) Field of Classification Search

CPC ..... C25F 3/16; C25F 3/18; C25F 3/22; C25F 3/24; C25F 3/26

See application file for complete search history.

(56) References Cited

U.S. PATENT DOCUMENTS

| | | | | |
|---|---|---|---|---|
| 4,214,952 | A | 7/1980 | Kasahara | |
| 5,181,416 | A | 1/1993 | Evans | |
| 2002/0108861 | A1* | 8/2002 | Emesh | H01L 21/7684 205/81 |
| 2006/0266657 | A1 | 11/2006 | Berkovich | |
| 2008/0067077 | A1 | 3/2008 | Kodera | |
| 2008/0217186 | A1* | 9/2008 | Bohme | C25F 3/26 205/674 |
| 2010/0282613 | A1* | 11/2010 | Schuh | C25D 5/18 205/170 |
| 2014/0014530 | A1* | 1/2014 | Lin | A61F 2/86 205/660 |
| 2014/0018244 | A1* | 1/2014 | Taylor | H05H 7/20 505/300 |
| 2014/0186996 | A1 | 7/2014 | Takeuchi et al. | |

(Continued)

FOREIGN PATENT DOCUMENTS

| | | | |
|---|---|---|---|
| CN | 106637220 | A | 10/2015 |
| CN | 106567122 | A | 4/2017 |
| CN | 107675244 | A | 2/2018 |

(Continued)

OTHER PUBLICATIONS

Australian Patent Application No. 2001241462 (abandoned). See equivalent WO 2001/061080.

(Continued)

*Primary Examiner* — Nicholas A Smith
(74) *Attorney, Agent, or Firm* — David R. Crichton

(57) ABSTRACT

A low-hazardous electropolishing process has been developed to remove oxide layer(s) from the surface of nitinol needles. Low concentrations of citric acid and sulfamic acid are mixed with medium concentrations of sulfuric acid to use as an electrolyte solution. The process can be easily fitted into current suture needle manufacturing processes as well as into processes require electropolishing of nitinol-containing medical devices.

20 Claims, 5 Drawing Sheets
(5 of 5 Drawing Sheet(s) Filed in Color)

(56) References Cited

U.S. PATENT DOCUMENTS

| | | | | |
|---|---|---|---|---|
| 2015/0096790 | A1* | 4/2015 | Uzoh | H01L 23/49827 174/252 |
| 2018/0353990 | A1 | 12/2018 | Cannara | |

FOREIGN PATENT DOCUMENTS

| | | | |
|---|---|---|---|
| CN | 107460534 | B | 1/2019 |
| DE | 10037337 | A1 | 9/2001 |
| EP | 1255880 | A1 | 11/2002 |
| JP | 7062280 | B2 | 7/1995 |
| WO | 01/61080 | A1 | 8/2001 |

OTHER PUBLICATIONS

International Search Report for Application No. PCT/IB2020/059575, dated Jan. 11, 2021.

* cited by examiner

ELECTROLYTE SOLUTIONS FOR ELECTROPOLISHING OF NITINOL NEEDLES

FIELD OF THE INVENTION

The field of art to which this invention pertains is to the electropolishing of nickel-titanium (nitinol) alloy surfaces such as those found in medical devices and in particular for nitinol surgical needles.

BACKGROUND OF THE INVENTION

Nitinol is categorized as a shape memory/super elastic alloy that has found interesting applications in vast areas of engineering from aerospace to biomedical; the latter applications are due to its biocompatibility in addition to its unique properties. The unique properties such as shape memory and pseudoelasticity make nitinol an excellent candidate in many functional designs, such as super elastic suture needles. However, the manufacturing and processing complications of this alloy pose impediments to large scale industrial process. This invention presents a solution for manufacturing scale electropolishing process of nitinol-based medical devices and in particular nitinol suture needles.

Electropolishing the surface of nickel titanium alloy wire (e.g., nitinol) currently requires a solution that is either flammable because of the need to use a flammable and toxic solvent (e.g., see: "Electro-Polishing Fixture and Electrolyte Solution for Polishing Nitinol Stents and Method of Using Same", EP1255880A1) or is highly corrosive (i.e. fluoride) and alcohol based (e.g., see: "Electropolishing in Organic Solutions" US20060266657).

There is a need in this art for novel, non-hazardous electropolishing solutions for nickel-titanium comprising medical devices. The current invention presents an electropolishing solution and process for electropolishing a nickel-titanium alloy using a non-alcoholic, non-flammable aqueous solution.

SUMMARY OF THE INVENTION

One aspect of the invention relates to an electropolishing solution suitable for removing an oxide layer from a nickel-titanium surface comprising a non-alcoholic aqueous solution comprising:

about 25 to 50 weight % sulfuric acid,
about 0.5 to 10 weight % citric acid, and
about 0.2 to 2 weight % sulfamic acid.

Another aspect of the invention relates to a process for electropolishing metal surfaces comprising:

providing a metal;
providing an electropolishing device comprising at least one anode, at least one cathode and a bath for the containment of the novel electrolytic solutions of this invention in an amount of solution sufficient to immerse the metal;
contacting the anode to the metal;
immersing the metal into the electrolytic bath; and
subjecting the metal to a current between 1 and 5 amps for a period of time to polish the metal.

Typically, the electrolytic solution is maintained at a temperature from 40 to 80 C in the process and a current ranging from 1 to 5 amperes is maintained for a period from about 10 to 30 seconds.

These and other aspects and advantages of the present invention will become more apparent from the following description and accompanying drawings.

BRIEF DESCRIPTION OF THE DRAWINGS

The patent or application file contains at least one drawing executed in color. Copies of this patent with color drawings will be provided by the Patent and Trademark Office upon request and payment of necessary fee.

DETAILED DESCRIPTION OF THE INVENTION

Figure 1:
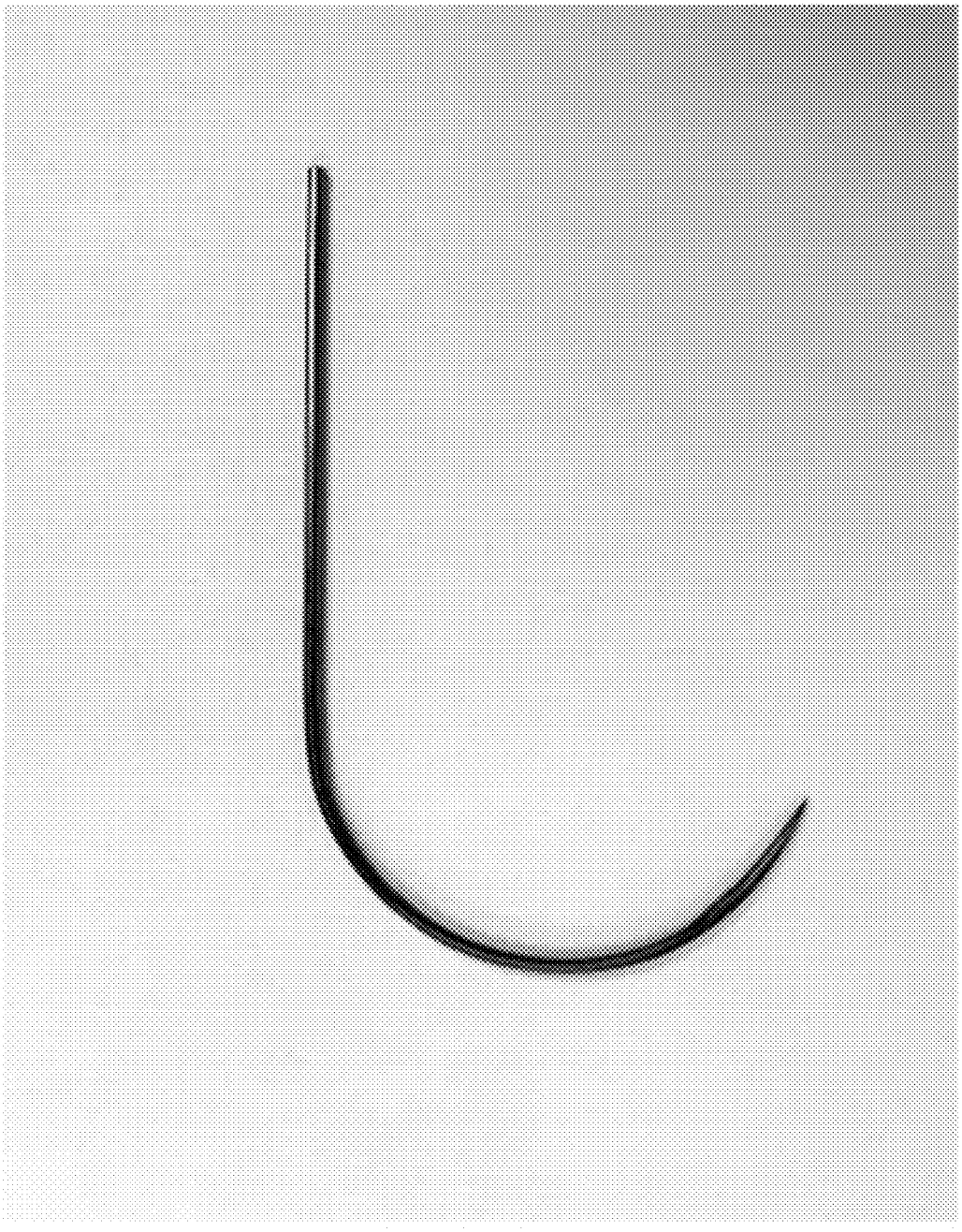
FIG. 1 is an image of a 40 mil (0.040 inch) nitinol needle prior to treatment with an electrolyte solution of this invention.

A method and electrolytic solution for electropolishing nickel-titanium alloy (nitinol) needles is developed to ensure removal of oxide layer(s) on the surface of the needles formed during a previous manufacturing step. We have found that a low concentration of citric acid and sulfamic acid mixed with a medium concentration of sulfuric acid in a non-alcoholic solution provides an excellent electrolytic solution for an electropolishing process that is non-flammable. The process can be easily fitted into the current manufacture processes with existing equipment.

Electropolishing of metal surfaces comprises passing an electrical current through the metal surface which is submerged in a bath with an electrolyte. The metal surface is connected to the positive pole (anode) of a power source and the negative pole is connected to special electrode (cathode) which is located inside the bath of electrolyte.

Regarding the useful concentrations of sulfuric acid in the electrolytic solution, the minimum concentration of sulfuric acid is about 25 wt. %. Higher concentration will work as well but the solution comes more corrosive. The recommended concentration is below about 50 wt. %, preferably ranges from about 30 to 45 wt. %, more preferably from about 35 to 40 wt. %, most preferably about 38 wt. % sulfuric acid.

The useful range of citric acid concentration in the electrolytic solution is from about 0.5 to 10 wt. %, preferably from about 0.8 to 5 wt. %, more preferably from about 1 to 2 wt. %, and most preferably about 1 wt. % citric acid.

The useful range of sulfamic acid concentration in the electrolytic solution is from about 0.2 to 2 wt. %, preferably from about 0.5 to 1.5 wt. %, more preferably from about 0.8 to 1.2 wt. %, and most preferably about 1 wt. % sulfamic acid.

Optionally, adding a substance that contributes a $Ni^{2+}$ ion to the electrolytic solution is desirable. Such $Ni^{2+}$ ion contributing substances include nickel salts such as nickel (II) nitrate, nickel (II) chloride, nickel (II) phosphate and nickel (II) sulphate and hydrates thereof. A preferred form is nickel (II) sulphate hexahydrate. The useful range of any of these nickel salt concentrations in the electrolytic solution is from about 0.2 to 2 wt. %, preferably from about 0.5 to 1.5 wt. %, more preferably from about 0.8 to 1.2 wt. %, and most preferably about 1 wt. %; most preferred is nickel sulphate hexahydrate at about 1 wt. %.

In use, the novel electrolytic solutions of this invention are used in a process for electropolishing metal surfaces comprising:

providing a metal;

providing an electropolishing device comprising at least one anode, at least one cathode and a bath for the containment of the electrolytic solution in an amount of solution sufficient to immerse the metal;

contacting the anode to the metal;

immersing the metal into the electrolytic bath; and subjecting the metal to a current between 1 and 5 amps for a period of time to polish the metal.

The temperature range employed for the electrolyte solution during the electropolishing process is from about 40 to 80 C. A typical temperature which covers the current electropolishing process for stainless steel needles is about 60 C.

Typical electrical currents suitable for the electropolishing processes of this invention comprise use of an electrical current from about 1 to 5 amperes (amps or A). One skilled in the art would appreciate that the current may vary based on the metal to be treated and its size. For electropolishing times of nitinol needles of 50 mil (0.050 inch) diameter is about 3 A for a process time for single needle from 10 to 30 seconds. One skilled in the art will recognize that the electropolishing process is complete when the color of the metal changes from dark black/dark brown to silver.

Conveniently, all of the electropolishing parameters used with the novel electrolytic solutions of this invention are within the current process parameters for electropolishing of stainless steel needles. This makes the process easily implemented into typical electropolishing lines without major change of capital equipment.

FIG. 1 depicts what a typical, 40 mil nitinol taper needle looks like prior to treatment with the novel electrolytic solutions of this invention. Referring to FIG. 1, one sees a dark black/dark brown oxide coating that begins at the tip of the needle to a location up on the stem of the needle.

Figure 2:
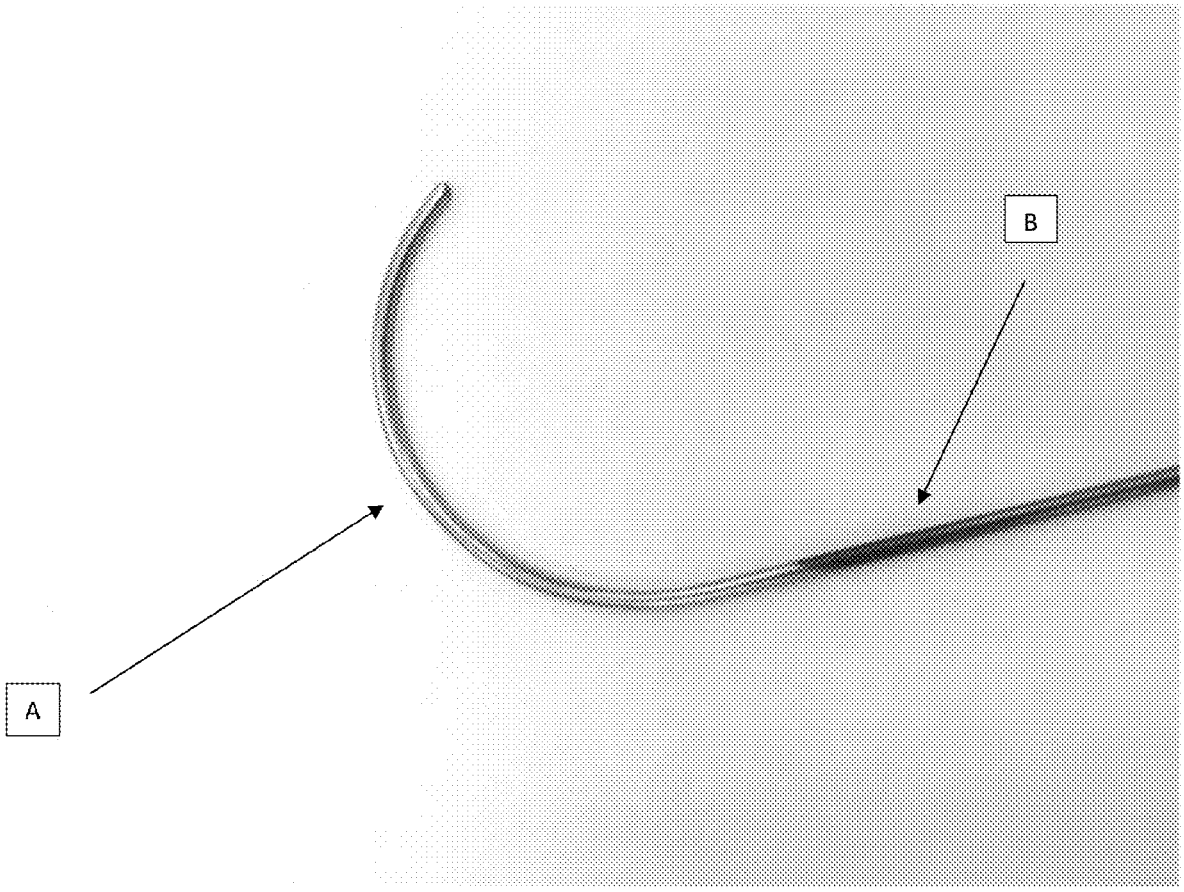
FIG. 2 is an image of an electropolished 50 mil (0.050 inch) nitinol wire treated with an electrolyte solution of this invention.

FIG. 2 shows the effect of electropolishing with the proposed process on a 50 mil wire. The straight section of the wire (area B) is left out of the polishing solution and is used as the control. As illustrated in the photo, the blue oxide was completely removed (area A) after 30 seconds at 50 C in an electrolyte solution containing 38 wt. % sulfuric acid, 1 wt. % citric acid and 1 wt. % sulfamic acid. The current was 3 A for the electropolishing process.

EXAMPLES

The following examples illustrate how the novel electrolytic solutions works on nitinol needles and its implication on the oxide removal was indicated by the adhesion between polished needle and silicone lubrication, which is measured by needle penetration measurements.

As will be demonstrated by the following needle penetration tests, the electropolished surface of the nitinol needles made from the inventive examples has good adhesion to silicone coating. Coating performance for medical device can be tested with a variety of friction or adhesion tests. In the case of surgical needles, coating performance and integrity is evaluated using a penetration testing device. A coated surgical needle is held using self-locking tweezers or a similar holding device. The coated needle is then passed through a medium that is representative of general human tissue. Approximately half of the needle length is passed through the medium and then retracted prior to the next pass. The test media is typically a type of synthetic rubber (Duraflex™, Manufacture by Monmouth Rubber and Plastic Corporation, Monmouth, N.J.). A typical test includes using 10 needles that are individually passed through the media 20 times each. The maximum force is recorded for each pass and used as a measure of the coating performance. Typically, the penetration force increases with each successive pass as the coating wears off from the needle. Further detail of the equipment and method can also be found in U.S. Pat. No. 5,181,416.

Figure 3:
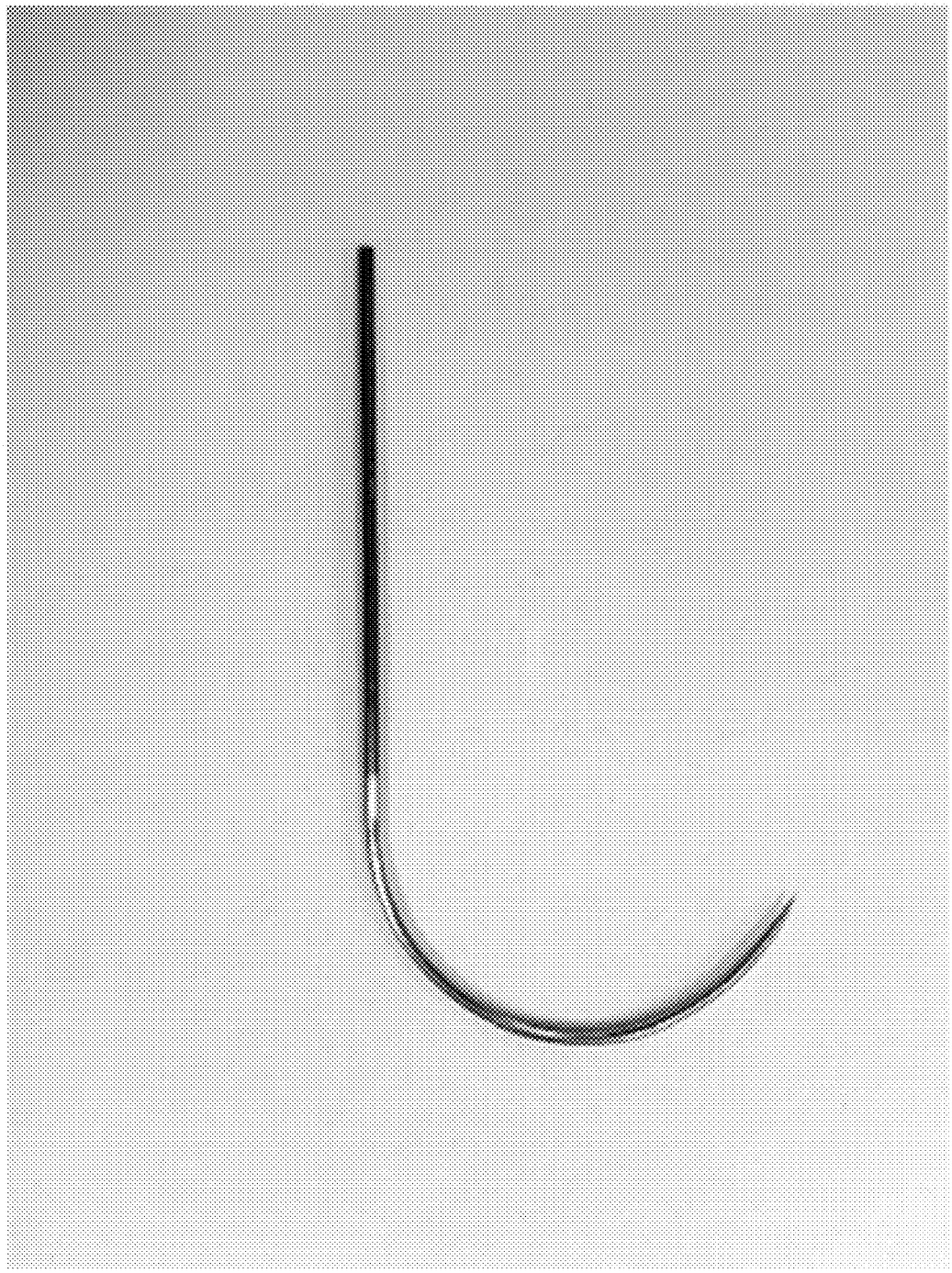
FIG. 3 is an image of an electropolished 40 mil (0.040 inch) nitinol needle treated with an electrolyte solution of this invention.

Inventive Example 1: Preparation of Inventive Electrolyte Solution 1 and Electropolishing of 40 Mil Taper Point Nitinol Needles with Inventive Solution 38.77 g of 98% sulfuric acid solution (Sigma Aldrich) was mixed with 1 g citric acid (Sigma Aldrich) and 1 g sulfamic acid (Sigma Aldrich) and 59.23 g of water at ambient temperature for one hour. This solution resulted in an aqueous solution containing about 38 wt. % sulfuric acid, 1 wt. % citric acid, and 1 wt. % sulfamic acid. 1 40 mil taper point Nitinol needle was used as an anode through which a 3 A current flowed for 30 seconds in this electrolyte solution at 60 C. The oxide on the surface of the needle (not shown) was removed and the needle turned silver as the result of electropolishing, as shown in FIG. 3.

Figure 4:
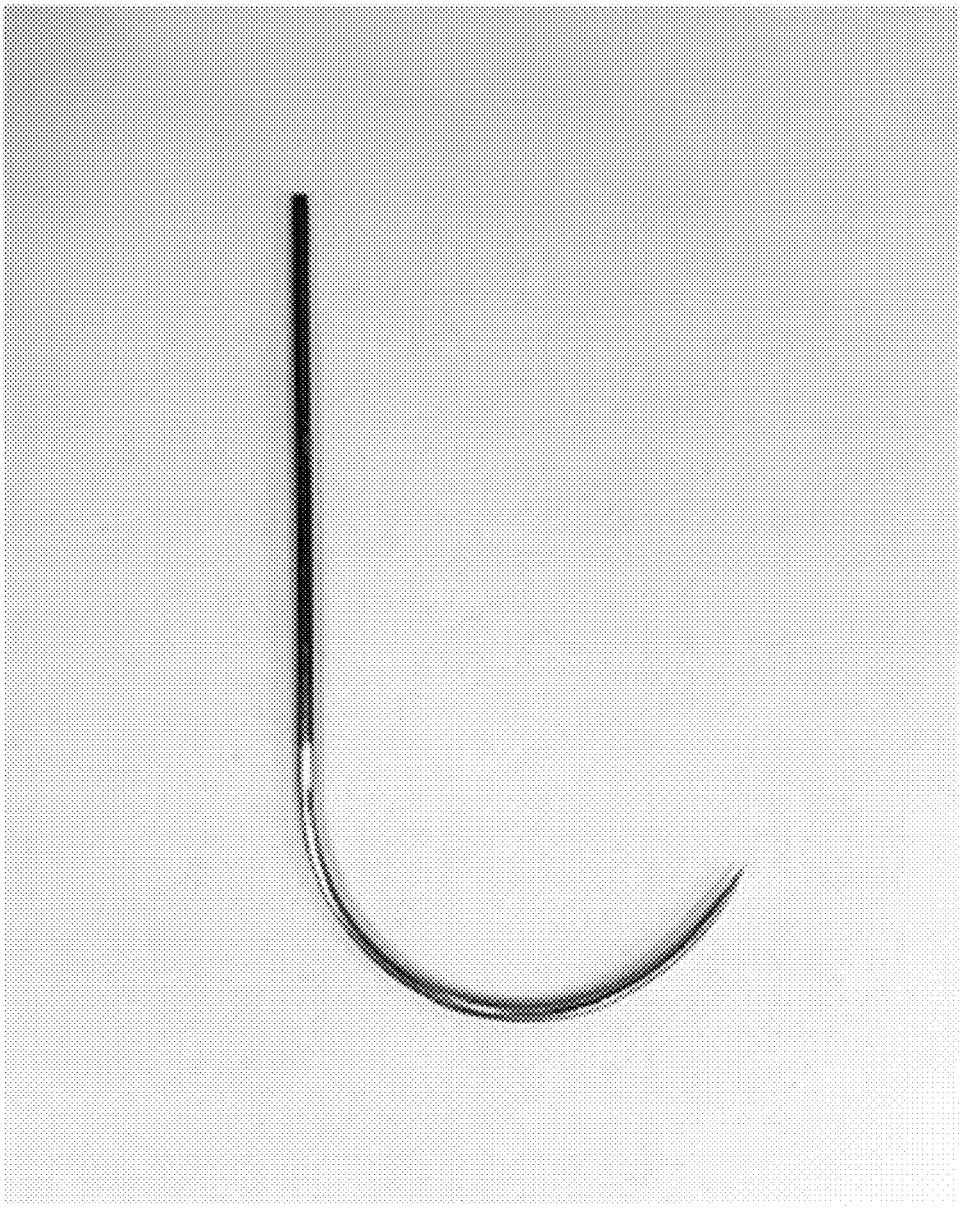
FIG. 4 is an image of an electropolished 40 mil (0.040 inch) nitinol needle treated with an electrolyte solution of this invention.

Inventive Example 2: Preparation of Inventive Electrolyte Solution 2 and Electropolish of 40 Mil Taper Point Nitinol Needle with this Solution 37.76 g of 98% sulfuric acid solution (Sigma Aldrich) was mixed with 1 g citric acid (Sigma Aldrich), 1 g sulfamic acid (Sigma Aldrich), 1 g nickel (II) sulfate hexahydrate (Sigma Aldrich) and 59.24 g of water at ambient temperature for one hour. This solution resulted in an aqueous solution containing about 38 wt. % sulfuric acid, 1 wt. % sulfamic acid, 1 wt. % citric acid, and 1 wt. % nickel (II) sulfate hexahydrate. 1 40 mil tapper point Nitinol needle was used as an anode through which 3 A current flowed for 15 seconds in this electrolyte solution at 60 C. The dark purple oxide on the surface of the needle (not shown) was removed and the needle turned silver as the result of electropolishing, as shown in FIG. 4. It should be noted that it only took half of the time (15 seconds vs. 30 seconds) to complete the oxide removal from nitinol needles compared to Inventive Example 1.

Control Example 1: Preparation of Conventional Electrolyte Solution Containing Sulfuric Acid Only 38.77 g of 98% sulfuric acid solution was mixed with 61.23 g of water at ambient temperature for one hour. This solution resulted in an aqueous solution containing about 38 wt. % sulfuric acid. One 40 mil taper point nitinol needle was used as an anode through which a 3 A current flowed for 30 seconds in this electrolyte solution at 60 C. No sign of color change was observed (not shown) on the nitinol needle. The treatment time was conducted for an additional 2 minutes and the color of the needles remain unchanged, which indicates oxide layer on the surface of nitinol needles is unable to be removed using sulfuric acid only in the electrolytic solution.

Figure 5:
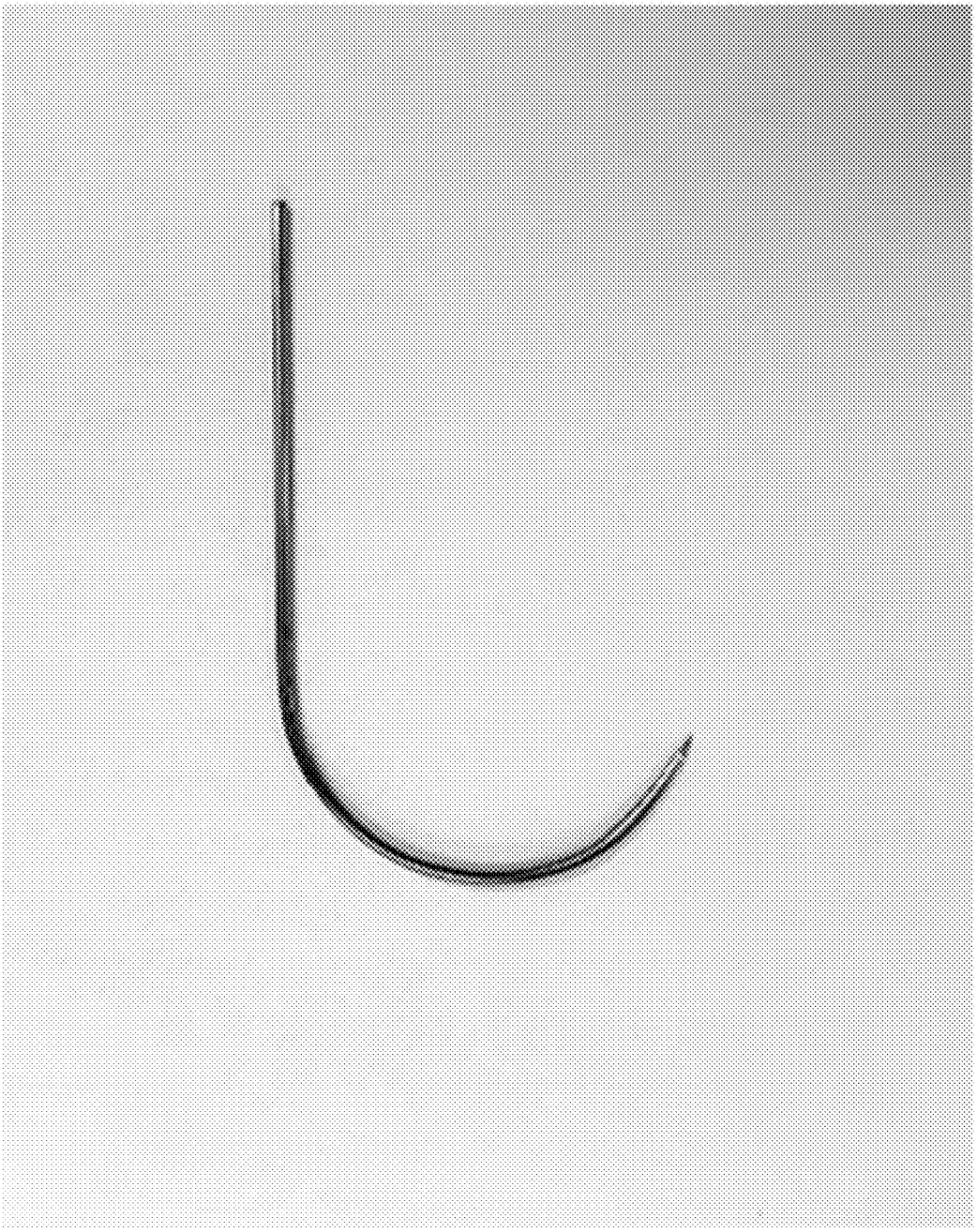
FIG. 5 is an image of an electropolished 40 mil (0.040 inch) nitinol needle treated with a comparative electrolyte solution that is not within the scope of this invention

Control Example 2: Preparation of Conventional Electrolyte Solution Containing Sulfuric Acid and Citric Acid Only 38.77 g of 98% sulfuric acid solution and 1 g of citric acid was mixed with 60.23 g of water at ambient temperature for one hour. This solution resulted in an aqueous solution containing about 38 wt. % sulfuric acid and 1 wt. % citric acid. One 40 mil taper point nitinol needle was used as an anode through which a 3 A current flowed for 30 seconds in this electrolyte solution at 60 C. No sign of color change was observed on the nitinol needle. The treatment time was conducted for an additional 2 minutes and the color of the needles changed slightly to deep blue, as illustrated in FIG. 5, which indicates that the oxide removal on the surface of nitinol needles is not efficient using sulfuric acid and citric acid in the electrolytic solution.

Penetration Test Examples: Coating and Testing of Nitinol Needles

One set of 10 electropolished 40 mil tapered point nitinol needles were coated with silicone solution described in Example 1a with the method described in Example 2a of US Patent Publication US2018/0353990, together with equal number of unpolished nitinol needles. One set of conventional stainless steel needles with the same geometry (CT-1) was also coated at the with the same silicone solution. All 6 sets of needles were subjected to penetration testing and the results are summarized in Table 1.

TABLE 1

Multiple Pass Penetration Tests.

| Entry | 1st Pass Penetration Force (g) | 10th Pass Penetration Force (g) | 20th Pass Penetration Force (g) |
|---|---|---|---|
| Non-Electropolished Nitinol Needle | 142 | 167 | 175 |
| Inventive Example 1 | 119 | 132 | 138 |
| Inventive Example 2 | 116 | 134 | 139 |
| Control Example 1 | 139 | 169 | 177 |
| Control Example 2 | 135 | 165 | 173 |
| Conventional Stainless Steel Needle | 122 | 133 | 135 |

Referring to Table 1, oxides on the surface of nitinol needles (resulting from a previous process step) does affect the adhesion of silicone coating layer to the needle. Oxide removal by electropolishing leads to better adhesion between silicone lubrication layer to the surface of nitinol needles, as illustrated by the improvement of penetration performance in the polished needles (Inventive Examples 1 and 2) compared with the penetration performance of the non-polished needles and those nitinol needles prepared from control examples (Control Example 1 and Control Example 2). The penetration performance of electropolished nitinol needles treated with the novel electrolytic solutions of this invention (Inventive Examples 1 and 2) are comparable to the conventional stainless steel needles not having an oxide layer and having the same silicone coating.

In summary, a low cost, low-hazardous nonflammable electrolytic solution was developed to remove the oxide layer on the surface of nitinol needles. Low concentrations of citric acid and sulfamic acid was added into medium concentration of sulfuric acid. This solution can be easily added into the current electropolishing equipment.

Although this invention has been shown and described with respect to detailed embodiments thereof, it will be understood by those skilled in the art that various changes in form and detail thereof may be made without departing from the spirit and scope of the claimed invention.

I claim:

1. An electropolishing device comprising a bath for the containment of an electropolishing solution comprising a non-alcoholic aqueous solution comprising:

a) 25 to 50 weight % sulfuric acid,
b) 0.5 to 10 weight % citric acid, and
c) 0.2 to 2 weight % sulfamic acid;
and a medical device having a nickel-titanium surface with an oxide layer and connection to a source of electric current for electropolishing.

2. The electropolishing device of claim 1, wherein the non-alcoholic aqueous solution comprises:

a. 30 to 45 weight % sulfuric acid,
b. 0.8 to 5 weight % citric acid, and
c. 0.5 to 1.5 weight % sulfamic acid.

3. The electropolishing device of claim 1, wherein the non-alcoholic aqueous solution comprises:

a. 35 to 40 weight % sulfuric acid,
b. 1 to 2 weight % citric acid, and
c. 0.8 to 1.2 weight % sulfamic acid.

4. The electropolishing device of claim 1, wherein the non-alcoholic aqueous solution comprises:

a. 38 weight % sulfuric acid,
b. 1 weight % citric acid, and
c. 1 weight % sulfamic acid.

5. The electropolishing device of claim 1, wherein the non-alcoholic aqueous solution comprises:

a) 25 to 50 weight % sulfuric acid,
b) 0.5 to 10 weight % citric acid,
c) 0.2 to 2 weight % sulfamic acid, and
d) 0.2 to 2 weight % of a nickel salt and hydrates thereof.

6. The electropolishing device of claim 1, wherein the non-alcoholic aqueous solution comprises:

a) 35 to 40 weight % sulfuric acid,
b) 1 to 2 weight % citric acid,
c) 0.8 to 1.2 weight % sulfamic acid, and
d) 1 to 2 weight % of a nickel salt and hydrates thereof.

7. The electropolishing device of claim 1, wherein the non-alcoholic aqueous solution comprises:

a) 37 weight % sulfuric acid,
b) 1 weight % citric acid, and
c) 1 weight % sulfamic acid, and
d) 1 weight % nickel sulphate hexahydrate.

8. The electropolishing device of claim 1 wherein the medical device is a surgical needle.

9. The electropolishing device of claim 1 wherein the medical device is a nitinol surgical needle having improved penetration force as compared to a needle that has not been electropolished.

10. A process for electropolishing metal surfaces of the medical device of claim 1 comprising:

a) providing the medical device having the nickel-titanium surface with the oxide layer;
b) providing the electropolishing device comprising at least one anode, at least one cathode and the bath for the containment of the electropolishing solution of claim 1 in an amount of solution sufficient to immerse t e medical device;

c) contacting the anode to the medical device;

d) immersing the medical device into the bath; and e) subjecting the medical device to a current between 1 and 5 amps for a period of time to electropolish the medical device.

11. The process of claim 10, wherein the electropolishing solution has the composition of claim 2.

12. The process of claim 10, wherein the electropolishing solution has the composition of claim 3.

13. The process of claim 10, wherein the electropolishing solution has the composition of claim 4.

14. The process of claim 10, wherein the electropolishing solution has the composition of claim 5.

15. The process of claim 10, wherein the electropolishing solution has the composition of claim 6.

16. The process of claim 10, wherein the electropolishing solution has the composition of claim 7.

17. The process of claim 10, wherein the electropolishing solution is maintained at a temperature from 40 to 80° C.

18. The process of claim 10, wherein the current is maintained from about 10 to 30 seconds.

19. The process of claim 10 wherein the medical device is a surgical needle.

20. The process of claim 10 wherein the medical device is a nitinol surgical needle having improved penetration force as compared to a needle that has not been electropolished.

* * * * *